US005466125A

United States Patent [19]

Knott

[11] Patent Number: 5,466,125

[45] Date of Patent: Nov. 14, 1995

[54] ROTORS FOR GAS TURBINE ENGINES

[75] Inventor: David S. Knott, Derby, England

[73] Assignee: Rolls-Royce plc, London, England

[21] Appl. No.: 307,643

[22] PCT Filed: Feb. 23, 1993

[86] PCT No.: PCT/GB93/00372

§ 371 Date: Sep. 16, 1994

§ 102(e) Date: Sep. 16, 1994

[87] PCT Pub. No.: WO93/21425

PCT Pub. Date: Oct. 28, 1993

[30] Foreign Application Priority Data

Apr. 16, 1992 [GB] United Kingdom ..... 9208409

[51] Int. Cl.[6] ..... F01D 5/22

[52] U.S. Cl. ..... 416/193 A

[58] Field of Search ..... 416/193 A, 248

[56] References Cited

U.S. PATENT DOCUMENTS

| | | | |
|---|---|---|---|
| 4,655,687 | 4/1987 | Atkinson | 416/193 A |
| 5,049,035 | 9/1991 | Marlin | 416/193 A |
| 5,161,949 | 11/1992 | Brioude et al. | 416/193 A |
| 5,232,346 | 8/1993 | Mitchell, Jr. et al. | 416/193 A |

FOREIGN PATENT DOCUMENTS

| | | |
|---|---|---|
| 0370899 | 5/1990 | European Pat. Off. . |
| 0488874 | 6/1992 | European Pat. Off. . |
| 2660363 | 10/1991 | France . |
| 1093568 | 12/1967 | United Kingdom . |
| 2006883 | 5/1979 | United Kingdom . |

*Primary Examiner*—Edward K. Look
*Assistant Examiner*—James A. Larson
*Attorney, Agent, or Firm*—Cushman Darby & Cushman

[57] ABSTRACT

Fan blades of a rotor stage do not have platforms and separate wall members are provided to bridge the space between adjacent blades with the wall members defining an inner wall of a flow annulus through the rotor; each wall member has a plurality of hooks which extend radially inwardly to engage correspondingly shaped hooks provided on the radially outer face of the disc and further hooks engage rings mounted on the rotor adjacent to the disc to lock the wall member in position and insure that the hooks on the wall member engage the hooks on the radially outer face of the disc.

6 Claims, 5 Drawing Sheets

ROTORS FOR GAS TURBINE ENGINES

FIELD OF THE INVENTION

The present invention relates to air compressing rotors and in particular to a fan rotor for a gas turbine engine.

BACKGROUND OF THE INVENTION

A conventional fan rotor for compressing air comprises a disc having a plurality of radially extending blades mounted thereon. The fan blades are mounted on the disc by inserting the radially inner end of the blades in correspondingly shaped retention grooves in the radially outer face of the disc. The fan blades do not have platforms so the inner wall of an annulus for the compressed air is formed by fastening separate wall members to the radially outer face of the disc. The separate wall members bridge the space between pairs of adjacent blades to define the inner annulus wall.

It is known to fasten the wall members, defining the inner wall of the compressed air annulus, to the disc by feet which extend radially inwardly. The feet of the wall members engage complementary grooves, of dovetail cross-section, in the radially outer face of the disc. Fitting of the wall members is achieved by sliding the feet into the grooves in a direction axially of the disc.

This known method of attaching the wall members to the disc has the disadvantage that the grooves in the radially outer face of the disc have to be manufactured to within quite close tolerances to receive the feet of the wall members.

The present invention seeks to provide a rotor in which the inner wall of the flow annulus is defined by a plurality of wall members which are fastened to the disc in such away that grooves for their attachment are not required in the radially outer face of the disc.

SUMMARY OF THE INVENTION

According to the present invention a rotor for a gas turbine engine comprises a rotor disc which has a radially outer face on which a plurality of radially extending blades are mounted, separate wall members are provided to bridge the space between adjacent blades to define an inner wall of a flow annulus through the rotor, each of the wall members have a plurality of hooks which extend radially inwardly to engage correspondingly shaped hooks provided on the radially outer face of the disc, characterised in that an at least one further hook is provided on each of the wall members which extends radially outward to engage an annular member mounted on the rotor adjacent the disc to ensure engagement of the hooks on the wall member with the hooks on the radially outer face of the disc.

In one embodiment of the present invention the at least one further hook extends radially outward to engage an annular member mounted on the rotor downstream of the disc.

In a further embodiment of the present invention two further hooks are provided on each wall member, one of the further hooks extends radially inward to engage an annular member mounted on the rotor upstream of the disc, the other further hook extends radially outward to engage an annular member mounted on the rotor downstream of the disc.

Preferably the at least one further hook which extends radially outward is urged into engagement with an annular member mounted on the rotor by centrifugal forces acting thereon.

A strip of flexible material may be provided at the edges of each of the wall members adjacent the fan blades, the strips of material effecting a seal between the wall members and the adjacent blades.

The wall members may be turned out of metal, made from a composite or a made from a combination of metal and composite material.

BRIEF DESCRIPTION OF THE DRAWINGS

The present invention will now be described with reference to the accompanying drawings in which.

DETAILED DESCRIPTION OF THE INVENTION

Figure 1:
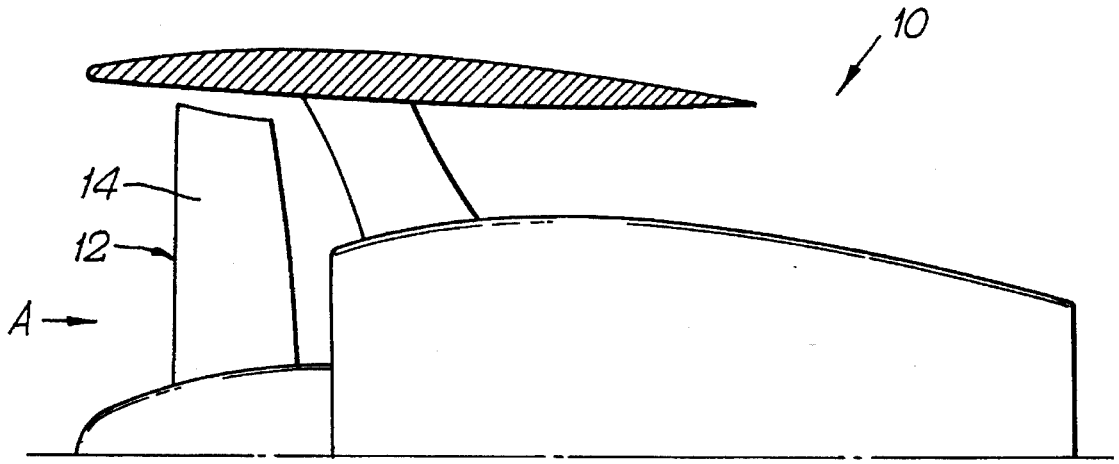
FIG. 1 is a diagrammatic view of a gas turbine engine incorporating a rotor in accordance with the present invention.

Referring to FIG. 1 a gas turbine engine 10, which operates in conventional manner, has a fan rotor stage 12 arranged at its upstream end.

Figure 2:
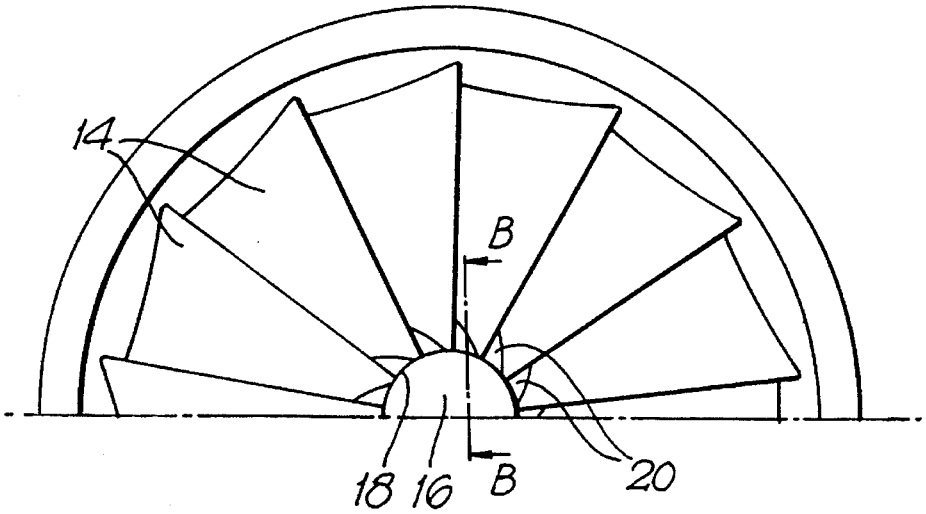
FIG. 2 is a view of the rotor in the direction of arrow A in FIG. 1.

The fan stage 12 (FIG. 2) consists of a number of fan blades 14 which are mounted on the radially outer face 18 of a disc 16. The fan blades 14 do not have platforms and the spaces between adjacent pairs of blades are bridged by wall members 20. The wall members 20 are fastened to the radially outer face 18 of the disc 16 and define the inner wall of an annulus for the air compressed by the fan.

Figure 3:
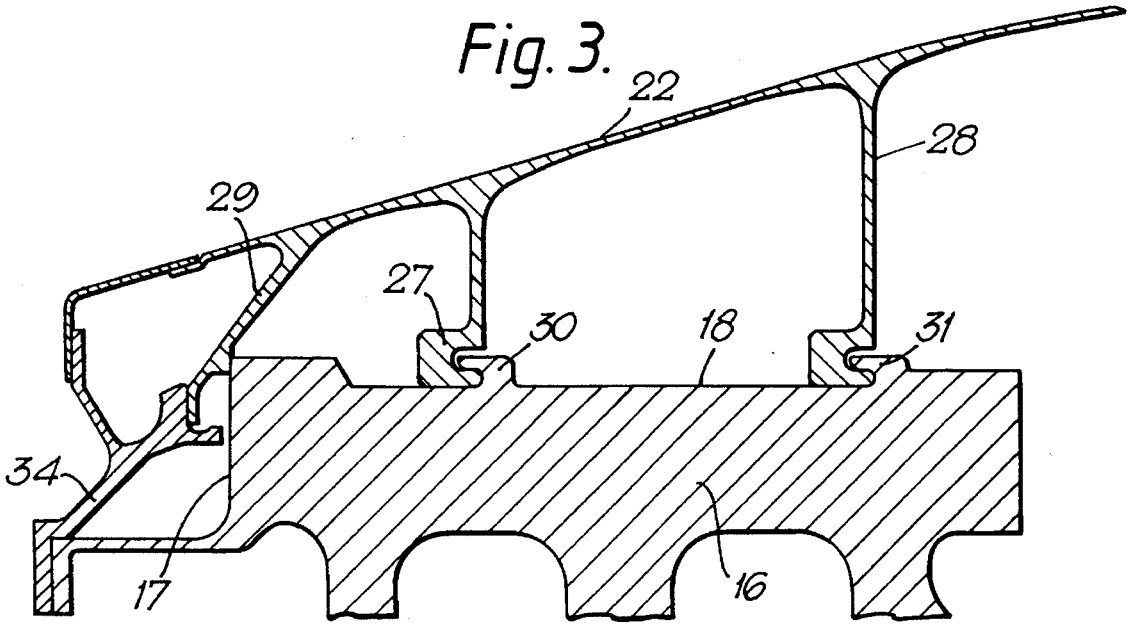
FIG. 3 is a cross-sectional view along line BB in FIG. 2 of a wall member in accordance with one embodiment of the present invention.
Figure 4:
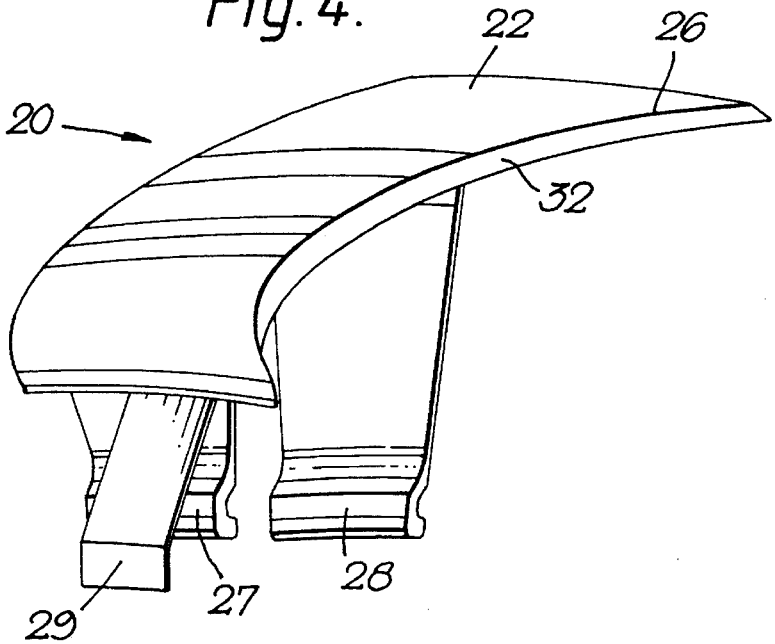
FIG. 4 is a pictorial view of a wall member in accordance with the embodiment of the present invention shown in FIG. 3.

A wall member 20 in accordance with one embodiment of the present invention is more clearly shown in FIG. 4. Each wall member 20 consists of a platform 22 having side edges 26 which are in close proximity to the shanks of the adjacent fan blades 14. A pair of hooks 27 and 28 are provided on the wall member 20 and extend radially inwardly of the platform 22. The hooks 27 and 28 provided on the platform 22 of the wall member 20 engage similarly shaped hooks 30 and 31 (FIG. 3) which extend radially outwardly from the radially outer face 18 of the disc 16.

The upstream end of the platform 22 of the wall member 20 is provided with a further hook 29. The hook 29 extends radially inwardly of the platform 22 and is inclined at an angle to the platform 22 to engage the upstream face 17 of the disc 16. Axial movement of the wall members 20 is prevented by mounting an annular ring 34 on the upstream face 17 of the disc 16. The ring 34 holds the hook 29 against the upstream face 17 of the disc 16 to lock the wall members 20 in position. Locking the wall members 20 in position ensures engagement of the hooks 27 and 28 on the platform 22 with the hooks 30 and 31 on the radially outer face 18 of the disc 16.

Figure 5:
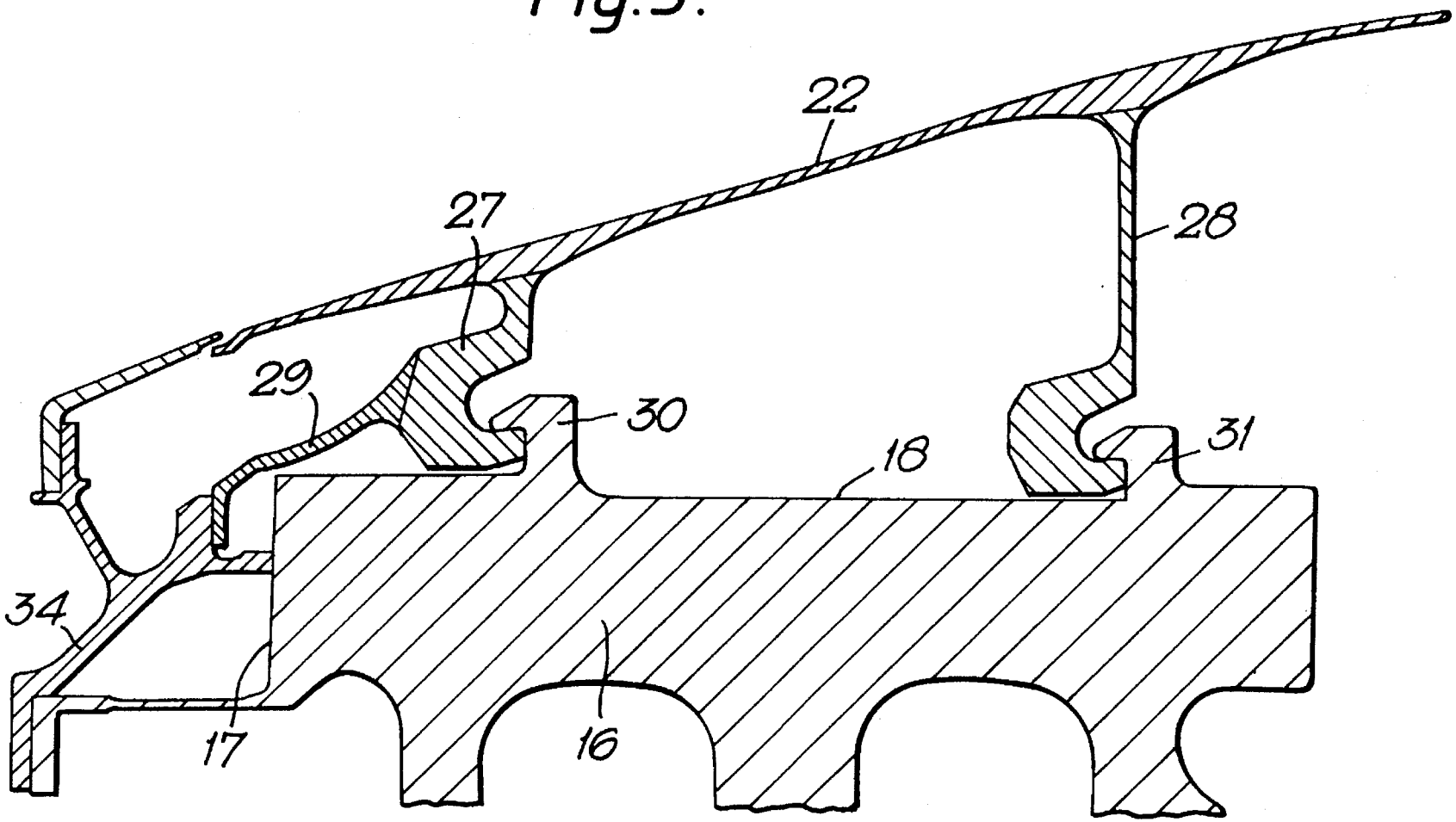
FIG. 5 is a cross-sectional view along line BB in FIG. 2 of a wall member in accordance with a second embodiment of the present invention.
Figure 6:
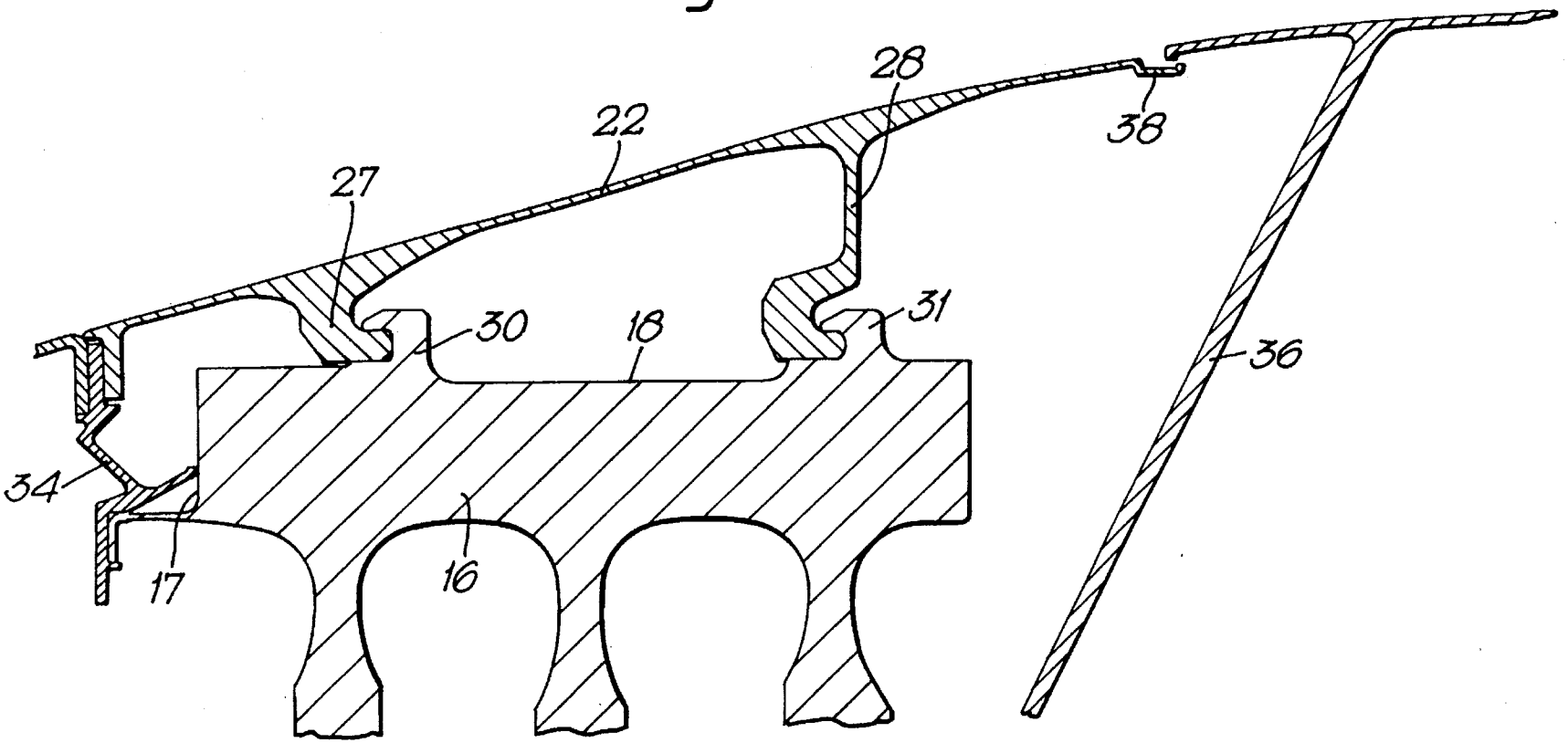
FIG. 6 is a cross-sectional view along line BB in FIG. 2 of a wall member in accordance with a third embodiment of the present invention.
Figure 7:
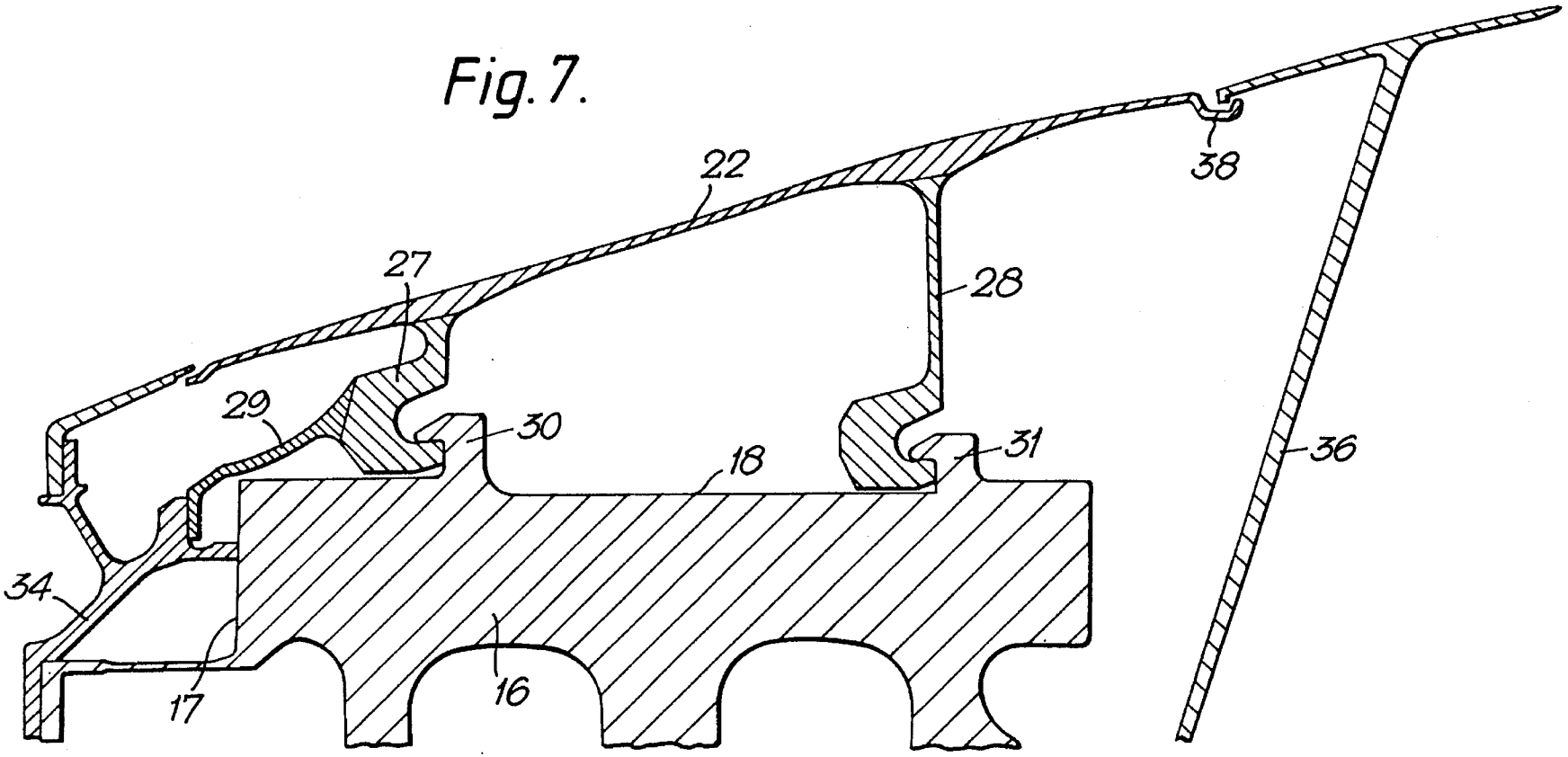
FIG. 7 is a cross-sectional view along line BB in FIG. 2 of a wall member in accordance with a fourth embodiment of the present invention.

FIGS. 5–7 show further embodiments of the present invention in which the same reference numerals have been used for integers common to all embodiments.

In the second embodiment of the present invention, shown in FIG. 5, the hooks 28 on the platform 22 are an interference fit with the hooks 30 and 31 on the radially outer face 18 of the disc 16. The hook 29 is connected directly to the hook 27 at the upstream end of the platform 22. The hook 29 engages with the ring 34 mounted on the upstream face 17 of the disc 16 to urge the hooks 27 and 28 into engagement with the hooks 30 and 31 on the radially outer face 18 of the disc 16.

FIG. 6 shows a third embodiment of the present invention in which a hook 38 urges the hooks 27 and 28 on the platform 22 into engagement with the hooks 30 and 31 on the radially outer face 18 of the disc 16. The hook 38 is connected directly to the downstream end of the platform 22. The hook 38 is urged radially outward, by the centrifugal forces which in operation act thereon, so that the hook 38 engages an annular member 36 mounted on the rotor downstream of the disc 16.

FIG. 7 shows a fourth embodiment of the present invention in which a hook 29 is provided at the upstream end of the platform 22 and a hook 38 is provided at the downstream end of the platform 22. The hook 29 extends radially inward and engages ring 34 mounted on the upstream face 17 of the disc 16. The hook 38 extends radially outward and engages an annular member 36 mounted on the rotor downstream of the disc 16. The hook 38 is urged into engagement with the annular member 36 by the centrifugal forces acting thereon. The hooks 29 and 38 ensure that the hooks 27 and 28 engage the hooks 30 and 31 on the radially outer face 18 of the disc 16.

In all the embodiments of the present invention the side edges 26 of the platform 22 of the wall members 20 are provided with a flexible strip 32 of a material such as rubber. The strip of material 32 along each edge 26 of the platform 22 projects so that it abuts the adjacent fan blade 14. The material strip 32 thus seals between the wall member 20 and the fan blades 14.

The wall members 20 shown in FIGS. 3, 4 and 6 are manufactured from a metal such as aluminium. The wall members 20 are turned out of aluminium so that the hooks 27, 28 and 29 are formed integrally with the platform 22. However it will be appreciated by one skilled in the art that the wall members 20 could be made from a composite material or from a combination of metal and composite material as shown in FIGS. 5 and 7.

I claim:

1. A rotor for a gas turbine engine comprising a rotor disc having a radially outer face on which a plurality of radially extending blades are mounted with a space between adjacent blades, a separate wall member being provided to bridge said space between adjacent blades to define an inner wall of a flow annulus through the rotor, each of the wall members having a plurality of hooks which extend radially inwardly to engage correspondingly shaped hooks provided on the radially outer face of the disc, at least one further hook being provided on each of the wall members which extends in a first direction generally radially inwardly and then generally axially so as to underlie in a radial sense an annular member so as to engage said annular member mounted on said rotor adjacent said disc to ensure engagement of the hooks on the wall member with the hooks on the radially outer face of the disc by radially outward movement of at least a portion of said one further hook under the action of centrifugal force when the engine is operating.

2. A rotor as claimed in claim 1 wherein the annular member is mounted on the rotor downstream of the disc.

3. A rotor as claimed in claim 2 wherein the at least one further hook is connected directly to the downstream end of the wall member.

4. A rotor as claimed in claim 1 wherein one additional hook is provided on each wall member, said one additional hook engaging a second annular member, said one additional hook having a portion extending radially inwardly to engage said second annular member mounted on the rotor upstream of the disc.

5. A rotor as claimed in claim 1 in which a strip of flexible material is provided at the edges of each of the wall members adjacent the blades, the strips of material effecting a seal between the wall members and the adjacent blades.

6. A rotor as claimed in claim 1 in which the wall members are turned out of metal.

* * * * *